US011371509B2

(12) United States Patent
Blad

(10) Patent No.: US 11,371,509 B2
(45) Date of Patent: Jun. 28, 2022

(54) PARALLEL CIRCULATION PUMP COORDINATING CONTROL ASSEMBLY

(71) Applicant: GRUNDFOS HOLDING A/S, Bjerringbro (DK)

(72) Inventor: Thomas Blad, Bjerringbro (DK)

(73) Assignee: GRUNDFOS HOLDING A/S, Bjerringbro (DK)

( * ) Notice: Subject to any disclaimer, the term of this patent is extended or adjusted under 35 U.S.C. 154(b) by 97 days.

(21) Appl. No.: 16/490,129

(22) PCT Filed: Feb. 26, 2018

(86) PCT No.: PCT/EP2018/054693
§ 371 (c)(1),
(2) Date: Aug. 30, 2019

(87) PCT Pub. No.: WO2018/158197
PCT Pub. Date: Sep. 7, 2018

(65) Prior Publication Data

US 2020/0011330 A1 Jan. 9, 2020

(30) Foreign Application Priority Data

Mar. 3, 2017 (EP) ..... 17159191

(51) Int. Cl.
*F04D 13/06* (2006.01)
*F04D 13/12* (2006.01)
(Continued)

(52) U.S. Cl.
CPC ..... *F04D 13/06* (2013.01); *F04D 13/12* (2013.01); *F04D 15/0066* (2013.01);
(Continued)

(58) Field of Classification Search
None
See application file for complete search history.

(56) References Cited

U.S. PATENT DOCUMENTS 3,511,579 A * 5/1970 Gray ..... F04D 15/029 417/6
5,090,872 A * 2/1992 Kuwabara ..... F04B 49/065 417/45

(Continued)

FOREIGN PATENT DOCUMENTS

CN 104885024 A 9/2015
EP 0735273 A1 10/1996

(Continued)

*Primary Examiner* — Peter J Bertheaud
*Assistant Examiner* — Geoffrey S Lee
(74) *Attorney, Agent, or Firm* — McGlew and Tuttle, P.C.

(57) ABSTRACT

A circulation pump assembly (22) includes an electrical drive motor (10) and an electronic control device (12) controlling the drive motor (10). The control device (12) is configured for the speed control of the drive motor (10) according to a control schema (I, II, III). The control device (12) includes a detection function (42) which is configured to detect a condition variable representing an operating condition, from a parallel flow path (16, 18, 20) with a second circulation pump assembly (22). The control device (12) is also configured such that it can change the control schema (I, II, III) on the basis of a condition variable detected by the detection function (42). Further an arrangement of at least two such circulation pump assemblies (22) and a method for the control of such two circulation pump assemblies (22) are provided.

14 Claims, 5 Drawing Sheets

(51) Int. Cl.
*F04D 15/00* (2006.01)
*F04D 15/02* (2006.01)

(52) U.S. Cl.
CPC ..... *F04D 15/0072* (2013.01); *F04D 15/0209* (2013.01); *F04D 15/029* (2013.01); *F04D 15/0245* (2013.01)

(56) References Cited

U.S. PATENT DOCUMENTS

| | | | | |
|---|---|---|---|---|
| 2003/0235492 | A1* | 12/2003 | Mirsky | F04D 15/0022 415/1 |
| 2013/0108473 | A1* | 5/2013 | Tamminen | F04B 23/06 417/3 |
| 2015/0148972 | A1* | 5/2015 | Blaumann | F04D 13/14 700/282 |
| 2015/0286196 | A1* | 10/2015 | Acosta Gonzalez | G05D 7/0617 700/19 |
| 2018/0129177 | A1* | 5/2018 | Coin | F04D 15/0066 |
| 2018/0314270 | A1* | 11/2018 | Grøtterud | F04D 31/00 |

FOREIGN PATENT DOCUMENTS

| | | | |
|---|---|---|---|
| JP | 2015-025427 | A | 2/2015 |
| WO | 2009/079447 | A1 | 6/2009 |

* cited by examiner

PARALLEL CIRCULATION PUMP COORDINATING CONTROL ASSEMBLY

CROSS REFERENCE TO RELATED APPLICATIONS

This application is a United States National Phase Application of International Application PCT/EP2018/054693, filed Feb. 26, 2018, and claims the benefit of priority under 35 U.S.C. § 119 of European Application 17 159 191.0, filed Mar. 3, 2017, the entire contents of which are incorporated herein by reference.

TECHNICAL FIELD

The invention relates to a circulation pump assembly with an electrical drive motor as well as to a control device for the speed regulation of the drive motor as well as to an arrangement of two such circulation pump assemblies and to a method for controlling at least two circulation pump assemblies in a hydraulic circulation system.

TECHNICAL BACKGROUND

In hydraulic circulation systems such as heating or air-conditioning facilities, circulation pumps are applied in order to deliver a fluid heat transfer medium, for example water, in the circuit. Thereby, it is known to apply a central heat source, for example a heating boiler, from which the heat transfer medium is delivered into different heating circuits, for example into a heating circuit for floor heating and into a second heating circuit with standard radiators. At least one circulation pump assembly is thereby arranged in each of the heating circuits. With such an arrangement however, a part of the heating circuits runs through a common flow path, specifically that part through the central heat source or cold source, for example through the heating boiler. This leads to the volume flow in this common flow path being dependent on the delivery capacity of several pump assemblies, which renders the regulation and control of the individual circulation pump assemblies more difficult. If a single circulation pump assembly is provided for example with a function for the automatic adaptation of its control schema, then this can leads to incorrect functions given an arrangement of several heating circuits in parallel, since the pressure loss in the circuit of the first pump assembly increases on starting operation of a second circulation pump assembly due to the fact that the pressure loss in the common part of the circuit increases because of the increased delivery rate. This can lead to the first pump assembly wrongly adapting its power in an undesirable manner.

SUMMARY

Against this background, it is the object of the invention to improve a circulation pump assembly to the extent that such maladjustments are avoided given an arrangement of several circulation pump assemblies of the same type in a connected hydraulic system.

This object is achieved by a circulation pump assembly with features according to the invention, by way of the arrangement of at least two such circulation pump assemblies according to the invention and as well as by a method for the control of at least two circulation pump assemblies in a common hydraulic system, according to the invention.

The circulating pump unit according to the invention preferably has a pump housing with an inlet and an outlet in the known manner, via the inlet and the outlet the pump housing can be integrated into a pipeline of a first flow path of a hydraulic system.

The circulation pump assembly according to the invention, in the known manner comprises an electric drive motor and an electronic control device for controlling or regulating the drive motor. The control device for the speed regulation of the drive motor is thereby configured such that it controls or regulates the speed of the drive motor according to a control schema which is preferably stored in the control device. In particular, this means that the control device is configured to adjust and vary the speed of the drive motor according to the control schema. Concerning the circulation pump assembly, it is particularly the case of a centrifugal pump assembly with at least one impeller which is driven in rotation by the drive motor. Concerning the drive motor, it is particularly preferably the case of a wet-running electrical drive motor with which a rotor space, in which the rotor of the drive motor rotates, is separated from the stator space, in which the stator windings are arranged, by way of a can or can pot, so that the rotor rotates in the fluid to be delivered. According to the invention, such a circulation pump assembly in particular can be configured as a heating circulation pump assembly, i.e. as a circulation pump assembly for circulating a fluid heat transfer medium such as water, in a heating system or air-conditioning system.

According to the invention, the control device comprises a detection module or a detection function which is configured to detect a condition variable representing an operating condition, from a parallel, which means second flow path with a second circulation pump assembly preferably of the same type.

The second flow path is a flow path which runs separately and outside the pump housing of the circulation pump assembly. The second flow path preferably supplies a separate circuit or branch of the hydraulic system with fluid or liquid.

The condition variable to be detected is preferably a hydraulic condition variable such as for example a flow or preferably a variable representing a hydraulic condition. The control device of the circulation pump assembly is configured such that it can change the control schema, according to which its controls or regulates the electrical drive motor of the circulation pump assembly, on the basis of a condition variable detected by the detection function. I.e., the circulation pump assembly can recognize condition changes in a further circuit or branch of a hydraulic system via the detection function and adapt its own control schema on the basis of this condition variable. Hydraulic condition changes in a system, which are caused by at least one further circulation pump assembly in another, parallel branch of the hydraulic system can thus been taken into account and compensated by the circulation pump assembly on regulation, so that maladjustments of the regulation of the first pump assembly due to the starting operation or speed change at least of a second circulation pump assembly are avoided.

The circulation pump assembly according to the invention is preferably configured in such a way that it operates without a higher-level control device. Thus, several of the circulating pump assemblies according to the invention can preferably be used in several branches of a hydraulic system without the need for a higher-level control system. Due to the design according to the invention, the control scheme of each individual circulating pump assembly is adapted, preferably autonomously, depending on the state variables received, without the need for coordination by a higher-level control system.

In particular, the detection function can be configured such that it detects a condition variable which represents a flow caused by a second circulation pump assembly. The first pump assembly can therefore take into account the flow change in a common flow path or branch of the hydraulic system, said change being caused by the at least one second circulation pump assembly. Pressure losses in a common branch of the system and which are based on a flow change which was caused by another circulation pump assembly, can thus be taken into account in order to prevent undesirable maladjustments. In particular in a heating system, one can prevent the control device detecting an increase of the pressure losses mistakenly as a closure of radiator valves and thereupon reducing the speed or the delivery power of the associated pump assembly. In contrast, if the pressure loss in the common branch is caused by the increase of the delivery rate due to starting operation of a second circulation pump assembly, it is desirable to likewise increase the speed of the first circulation pump assembly, in order to be able to compensate this pressure loss where possible and to be able to continue to supply the associated hydraulic circuit or branch with adequate pressure. The detection function is preferably configured as a software module in the control device of the electrical drive motor and is further preferably connected to at least one communication interface, via which the condition variable can be detected. This can be a communication interface which alternatively or additionally can be used for further communication functions of the control device.

According to a preferred embodiment of the invention, the detection function is configured such that as a condition variable, as has been described above, it recognizes a signal which represents the switching-on and/or switching-off or a speed change at least of a second circulation pump assembly, and the control device is preferably configured such the drive motor is controllable by the control device whilst taking into account this detected signal. I.e., according to this embodiment, the condition variable merely represents the operating condition at least of a second circulation pump assembly, to the extent that on the basis of the condition variable, it can be recognized whether the at least one second circulation pump assembly is in operation or not or a speed change is effected. Hydraulic condition changes which are caused by the operation of the second circulation pump assembly can then be detected by the circulation pump assembly in another manner, for example via sensors present in the circulation pump assembly or via an evaluation of electrical variables of the drive motor, in order to determine for example the differential pressure in the circulation pump assembly. Then, given a detected pressure change, it can be determined whether this change results from the starting operation of the second circulation pump assembly or not, for example with the assistance of the detected condition variable. If the condition variable signalizes the starting operation or speed change of a second circulation pump assembly, then preferably from the change of the pressure, it can be automatically determined by the control device of the first circulation pump assembly as to what delivery rate the second circulation pump assembly produces or what adaptation of the control schema is necessary for compensation.

According to a further possible embodiment of the invention, the detection function can be configured for recognising a signal in the form of at least one predefined pattern of a hydraulic load acting upon the circulation pump assembly. Such a functionality permits the condition variable to be transmitted in the system in a hydraulic manner, so that separate communication paths for signal transmission, in particular an electrical connection between several circulation pump assemblies is not necessary. Thus, for example the circulation pump assembly can be configured such that with its starting operation, it produces a certain hydraulic pattern in the form of flow or pressure fluctuations, e.g. is briefly switched on and off successively several times when being switched on. This creates pressure or flow fluctuations in the hydraulic system, which can then be recognized as a condition variable by the sensor devices of a respective circulation pump assembly of the same type. On the basis of such pressure or flow fluctuations which are caused in a targeted manner when switching on a second circulation pump assembly, the control device of the circulation pump assembly can recognize that such a second circulation pump assembly has been switched on.

According to a further preferred embodiment of the invention, the control device comprises a communication interface which is connected to the detection function in a manner such that the detection function can receive a signal via the communication interface. The communication interface can thereby be an electrical interface or also an electromagnetic interface such as a radio interface. Alternatively, other suitable signal transmission paths and associated interfaces, for example an optical interface can be applied. If several circulation pump assemblies of the same type and with corresponding communication interfaces are used in a hydraulic system, then these circulation pump assemblies can communicate with one another and exchange the described condition variables via these communication interfaces. The condition variables can thereby be emitted and received as signals via the communication interfaces.

The control device preferably comprises a signal generating device which is configured to produce the signal representing the switching-on and/or switching-off or a speed change of the drive motor. This can either be a signal which is outputted via a communication interface as was described above, or however a signal which is transmitted in a hydraulic manner, as has likewise been mentioned above. For this, the drive motor can be activated such that it produces a certain hydraulic pattern in the hydraulic circulation system, in which the circulation pump assembly is applied, and this hydraulic pattern in turn can then be recognized by the detection device of a second circulation pump assembly of the same type.

It is to be understood that for this, the circulation pump assembly is configured to be used in a hydraulic circulation system together with a further circulation pump assembly of the same type, preferably one which is configured identically, wherein each of the circulation pump assemblies is arranged in a branch or circuit of the hydraulic circulation system and these circuits or branches lead via a common flow path or branch, such as a heating boiler for example. The individual circulation pump assembly in such an arrangement can detect the signal generated by the signal generating device of the other or several other circulation pump assemblies, as a condition variable and thereafter adapt its control schema.

The control device preferably comprises a communication interface which is connected to the signal generating device in a manner such that the signal generating device can emit a signal or a value via the communication interface. The signal or the value thereby represents a condition variable as has been described above. The communication interface can preferably be an electrical or electromagnetic interface in accordance with the aforementioned description, in order to output an electrical signal or an electromagnetic signal such as a radio signal, which can then be detected by a corresponding communication interface of a second circulation pump assembly. The communication interface is particularly preferably configured such that it cooperates with the signal generating device as well as with the detection function, so that the communication interface acts bidirectionally, i.e. can emit signals and can detect corresponding signals from another circulation pump assembly.

Particularly preferably, the communication interface can be configured such that it has a relay function which permits data received from another communication interface to be transferred further to a yet a further communication interface. This particularly lends itself if the communication interface is configured as radio interface. The communication interface can therefore simultaneously serve as a relay station which sends the radio signals further to further communication interfaces. Greater ranges can thus be bridged.

The signal generating device is particularly preferably configured such that via the communication interface, it outputs a delivery rate value representing the current delivery rate of the circulation pump assembly. This can then be detected by the communication interface of a second, connected circulation pump assembly, so that the control device of this second connected circulation pump assembly detects the detected delivery rate value as a condition variable and can accordingly adapt its control schema on the basis of this detected condition variable. The individual circulation pump assembly or its control device can therefore take into account the delivery rate value of a second or several further circulation pump assemblies which are arranged in the same hydraulic system, in order to adapt or correct its own control schema such that it can fulfil its desired function preferably independently of the further circulation pump assemblies.

As has already been indicated previously, the communication interface is particularly preferably configured for the communication connection with a communication interface of at least a second circulation pump assembly of the same type, preferably an identical one, and the control device of the circulation pump assembly is configured such that via the communication interface and its detection function, it can receive a condition variable from at least a second circulation pump assembly of the same type, preferably an identical one and that the control device then controls the drive motor of the circulation pump assembly whilst taking into account the condition variable received from the communication interface. In particular, this can comprise the adaptation of a control schema on the basis of the detected condition variable. Particularly preferably and as described above, the condition variable can represent a switching-on or switching-off of the at least one further circulation pump assembly or further preferably be a delivery rate value which represents the current delivery rate of the further circulation pump assembly.

According to a further preferred embodiment of the invention, the control device is configured such that the control schema, according to which the drive motor is regulated, comprises a pump characteristic curve which changes and is preferably shifted (moved), in dependence on a signal recognized by or received from the detection function, in particular on a received condition variable. Such a pump characteristic curve for example can be a proportional pressure characteristic curve or a constant pressure characteristic curve in the Q-H diagram, in which the pressure is plotted against flow. If the pump assembly is regulated according to such a characteristic curve as a control schema, then an increase of the flow in the common branch of the hydraulic system would lead to a higher pressure loss between the delivery side and the suction side of the circulation pump assembly, which would initiate the circulation pump into moving on the given characteristic curve into a region of lower delivery outputs whilst reducing the speed, which would then lead to the pressure available in the respective branch supplied by the circulation pump being too low. In order to compensate this, the pump characteristic curve for example can be shifted into the region of greater pressures, in order, given a constant flow, to then reach an operating point with a greater pressure and to therefore be able to retain the pressure in the respective branch despite the higher pressure loss in the common branch. Conversely, when it detects the switching-off or the reduction of the delivery rate of a further circulation pump assembly arranged in a parallel branch, the control device can shift the characteristic curve of its own control schema into the region of lower pressures, so that again the flow and the pressure available in its own branch can be kept essentially constant.

Further preferably, the control device is configured such that the pump characteristic curve of the control schema is shifted by a correction value which represents a function of a received or detected condition variable, in particular of the flow in the complete system, into which the circulation pump assembly is integrated. I.e. the control device is configured such that its detection function detects or receives the flow of further circulation pump assemblies in parallel branches and computes a correction value for shifting the pump characteristic curve, said correction value representing a function of this flow. The correction value can moreover preferably be proportional to a correction constant representing a hydraulic resistance in a common branch of the hydraulic system. This constant can be determined by the control device of the circulation pump assembly in an initialisation step or be manually inputted into the control device for example by way of suitable input means.

The control device is preferably provided with an initialisation function which via the described communication interface can communicate with the control devices of circulation pump assembly connected in parallel, in a manner such that the several circulation pump assemblies which are arranged in parallel branches can be switched on and off in a targeted manner, in order to then determine the changes of the hydraulic variables in the system and to compute the constant from these changes.

According to a further preferred embodiment of the invention, the control device can be configured such that after receiving a signal or a condition variable by its detection function, it automatically changes the control schema, according to which the drive motor is regulated, in dependence on the change of the hydraulic load and in particular shifts a pump characteristic curve forming the control schema. I.e., here the size or the magnitude of the adaptation of the control schema is rendered dependent on the size of the change of the hydraulic load, in particular of a flow which is to say delivery rate of a second circulation pump assembly. In particular, the hydraulic load or the change of the hydraulic load which is caused by further circulation pump assembly is taken into account to the extent that the hydraulic condition in the branch, in which the circulation pump assembly is arranged, is retained in an essentially unchanged manner. I.e., the pressure loss in a common branch and which is caused by the connection or the delivery output of a further pump assembly is essentially compensated by way of the operating point or the pump characteristic curve of the individual control schema being shifted into the region of higher or lower differential pressures in a manner depending on the change of the pressure loss in the common branch.

The communication interface is particularly preferably configured for the communication with several second circulation pump assemblies of the same type, preferably identical ones, and the control device is preferably configured such that it controls the drive motor whilst taking into account all signals or condition variables which are received by the communication interfaces. I.e. the circulation pump assembly is configured such that also more than two of these circulation pump assemblies can be arranged in several parallel branches of a hydraulic system and thus communicate with one another such that the changes of the hydraulic condition in the complete system which are caused by them can be taken into account by the individual circulation pump assemblies such that each circulation pump assembly preferably regulates its own drive motor such that the hydraulic conditions in the associated branch, in which the respective circulation pump assembly is arranged can be retained in a manner uninfluenced by the other circulation pump assemblies. I.e., the condition changes which are caused by the respective other circulation pump assemblies in the hydraulic system are compensated such that the circulation pump assembly can retain the desired differential pressure and/or the flow in the associated branch in an essentially unchanged manner.

It is to be understood that concerning the features, functions and method procedures/courses which have hitherto been described and which relate to the cooperation of several circulation pump assemblies, this means that the individual circulation pump assembly should be configured such that it can effect the described functionalities in cooperation with one or more circulation pump assemblies which are of the same type or are configured identically.

According to a particular embodiment of the invention, the control device of the circulation pump assembly can be configured such that it changes the control schema given a predefined condition variable which is detected by the detection function, in a manner such that the drive motor is switched off. Such a design of the circulation pump assembly permits the design of a priority circuit in a heating system, which permits the remaining heating circuits to be disconnected on heating service water. A circulation pump assembly, preferably a circulation pump assembly according to the preceding description can thus be arranged in a heating water flow path through a heat exchanger for heating service water. When it is brought into operation, this circulation pump assembly, via a signal generating device, can produce a signal which represents a predefined condition variable and which via a communication interface and suitable data connections or hydraulically in the described manner is transmitted to at least one further circulation pump assembly which detects this condition variable as a signal that that circulation pump assembly which serves for service water heating has been switched on. The control device which receives the signal can subsequently switch off its associated circulation pump assembly or its drive motor. For such an embodiment, it is advantageous if the predefined signal or the predefined condition variable is coded in a manner such that on starting operation of a complete system it can be assigned to a certain circulation pump assembly, so that on receiving the signal, further circulation pump assemblies can unambiguously recognize that the circulation pump assembly which serves for the service water heating has been brought into operation. Moreover, the circulation pump assembly can preferably have a sensor connection, to which a sensor for detecting the service water demand, for example a flow sensor which can be arranged in a service water conduit, can be connected. The control device of the circulation pump assembly can receive this sensor signal and evaluate it in a manner such that it automatically switches on the circulation pump assembly or its drive motor on the basis of the sensor signal. The service water heating can be autarkically controlled by a circulation pump assembly in this manner, without an overriding control device becoming necessary for starting operation of the circulation pump assembly.

The subject-matter of the invention is moreover the arrangement of at least two circulation pump assemblies according to the preceding description, wherein the at least two circulation pump assemblies are arranged in a common hydraulic circulation system. The hydraulic circulation system is thereby particularly preferably a hydraulic heating system or a hydraulic heating facility. This expressly includes an air-conditioning facility. Thereby, the two circulation pump assemblies are arranged in two branches or circuits of the circulation system which are parallel to one another, wherein these branches or circuits run out into at least one common flow path or have a common flow path. I.e., the fluid which is delivered by the two circulation pumps through the two branches always also flows through the common branch or section. The parallel branches or flow paths preferably lead to different consumers or separate sections of the hydraulic circuit system. The at least two branches are preferably consumer branches, in which at least one consumer such as for example a heat exchanger which forms the hydraulic resistance is arranged. Such a heat exchanger can be formed for example by a radiator or a floor heating circuit or however also a service water heat exchanger. The hydraulic resistances can thereby be situated in the individual branches, upstream and/or downstream of the circulation pump assembly. The circulation pump assembly in the parallel branches are of the same type and in particular are configured identically, as has been described above. At least the control device of one of the circulation pump assemblies comprises a signal generating device which outputs a condition variable which represents an operating condition of this circulation pump assembly. Thereby, as described beforehand, the condition variable can represent the switching-on and/or switching-off or however can also represent for example the delivery rate (delivery rate value). Moreover, at least the control device of one of the circulation pump assemblies is configured such that it controls the associated drive motor of this circulation pump assembly whilst taking into account the condition variable which is detected by its detection function and which is outputted by the other circulation pump assembly. This is preferably effected in the manner described above. The several circulation pump assemblies are preferably of the same type or configured identically, so that they can mutually take into account their influence upon the complete system.

Further preferred features of the arrangement of at least two or more circulation pump assemblies result from the complete preceding description. It is to be understood that the features which have been described by way of an individual circulation pump assembly can also be realized in an arrangement of several circulation pump assemblies.

The subject matter of the invention is moreover a method for the control of at least two circulation pump assemblies which are arranged in a hydraulic circulation system in branches which are parallel to one another. Thereby, as described beforehand, the parallel branches are configured such that they run out into a common flow path which closes a circuit via the branches in each case. However, the branches are also separate branches which supply different sections of the hydraulic system with fluid. According to the method, a control schema, according to which a first circulation pump assembly is controlled, is changed whilst taking into account the hydraulic power provided by the second circulation pump assembly, on starting operation of this second circulation pump assembly. A change in the total system can be compensated, in particular a pressure loss which occurs in a common branch or conduit section and which is caused by a change of the delivery rate provided by the second circulation pump assembly. The preceding description of the circulation pump assembly, in which preferred features of the method have likewise been described, is referred to regarding details and the exact course of the method. This is preferably expressly likewise the subject-matter of the method according to the invention.

As described, the at least two parallel branches of the hydraulic system run out into a common flow path. The at least one circulation pump assembly and preferably all circulation pump assemblies which are arranged in the parallel branches are controlled or regulated such that their respective control schema is adapted on the basis of a hydraulic loss in the common flow path or section of the flow path, in a manner such that a differential pressure across a hydraulic resistance situated in an individual one of the hydraulic branches has a predefined value. I.e., if the pressure loss in the common flow path increases, then the differential pressure which is provided by the circulation pump assembly in an individual branch must be increased, in order be able to retain a predefined differential pressure across the hydraulic resistance in the respective branch. I.e. the speed of the respective circulation pump assembly must be increased when the hydraulic resistance or pressure loss in the common flow path increases and accordingly reduced again when the pressure loss in the common flow path reduces.

Particularly preferably, a value of the hydraulic powers which are provided by the second circulation pump assembly is transferred from the second circulation pump assembly to the first circulation pump assembly or automatically from the first circulation pump assembly by way of a load change occurring in the first circulation pump assembly. Thus, for example the current delivery rate as a delivery rate value can be transmitted or signalized from one circulation pump assembly to the other circulation pump assembly. Alternatively, only the switching-on and switching-off can be signalized and the other circulation pump assembly can automatically recognize how greatly the pressure loss in the system changes due to the starting operation or the switching-off of the further circulation pump assembly. This can be detected by way of suitable pressure sensors in the circulation pump assembly and/or possibly derived from electrical variables of the drive motor of the individual circulation pump assembly.

The invention is hereinafter described by way of example and by way of the attached figures. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF PREFERRED EMBODIMENTS

Figure 1:
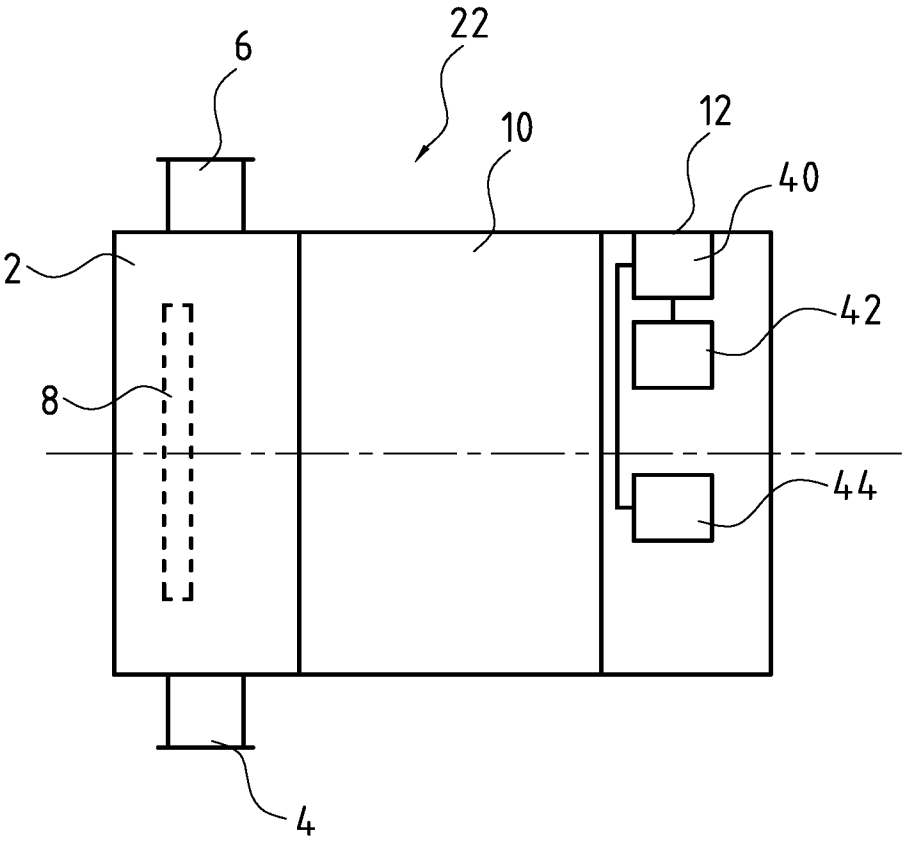
FIG. 1 is a schematic view of a circulation pump assembly according to the invention.

Referring to the drawings, the circulation pump assembly according to the invention is a centrifugal pump assembly which as a circulation pump assembly can be applied for example in a heating system or air-conditioning system, for circulating a fluid heat transfer medium such as water. It comprises a pump housing 2 with an inlet 4 as well as an outlet 6 and at least one impeller 8 which rotates in the inside. The impeller 8 is rotatingly driven by an electrical drive motor 10. A control device 12 which controls or regulates the electrical drive motor 10, in particular controls or regulates it in its speed, is moreover present in the circulation pump assembly. I.e. the speed of the drive motor 10 can be changed via the control device 12, for adaption to the hydraulic conditions. In as much as this is concerned, the circulation pump assembly corresponds to the construction of known circulation pump assemblies.

Figure 3:
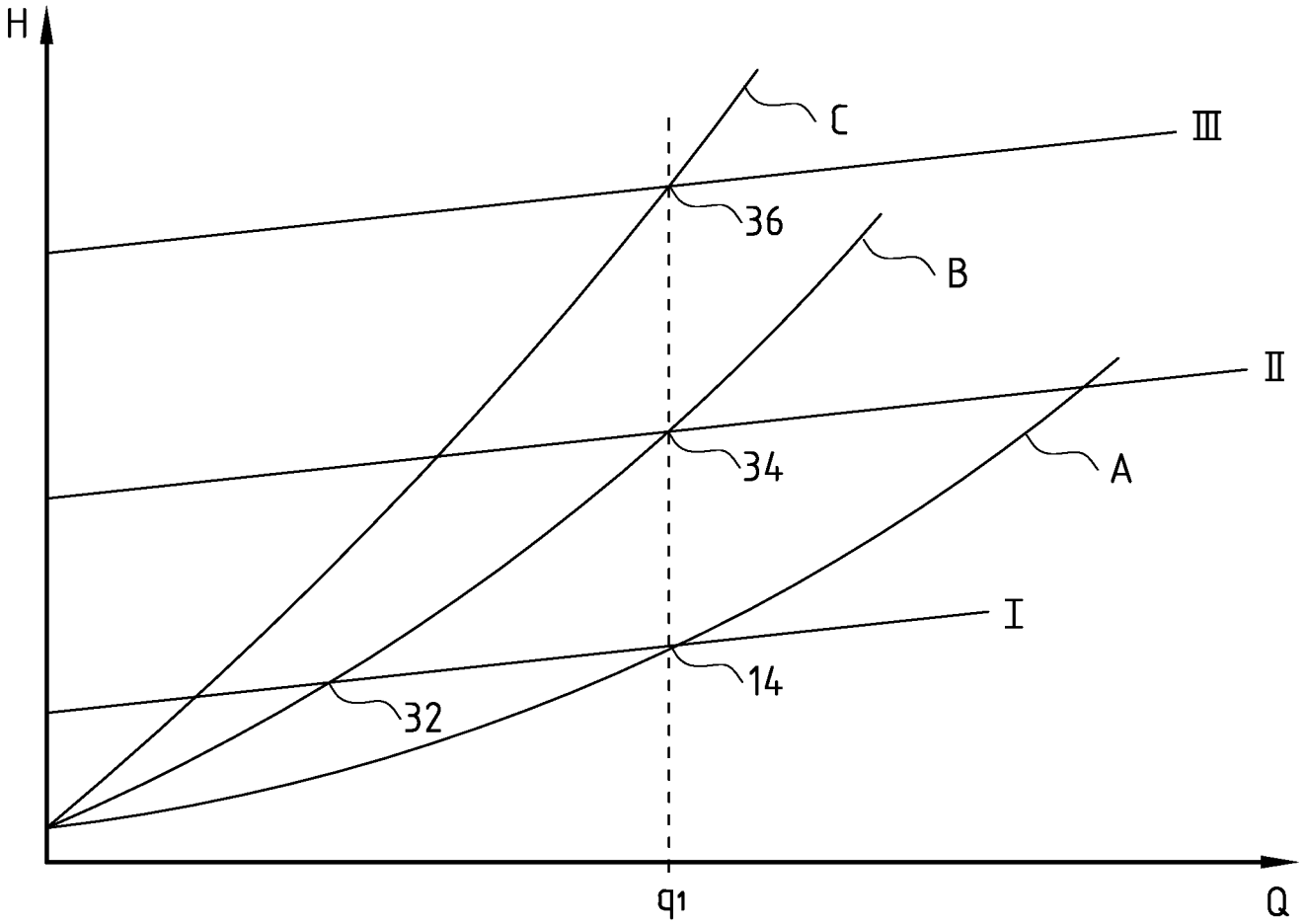
FIG. 3 is a QH diagram for representing the interaction of several circulation pump assemblies.

The control device 12 is configured such that it controls or regulates the drive motor 10 according to at least one control schema, i.e. for example according to a pump characteristic curve as is represented in FIG. 3. For example, it is known for example to apply proportional pressure curves as control schemas, according to which curves the pressure increases proportionally to the flow. Alternatively, for example control schemas with constant pressure curves can also be used, with which the drive motor is regulated such that the pressure retains a constant value independently of the flow. By way of example, FIG. 3 shows three proportional pressure curves I, II and III in a QH diagram, in which the pressure H is plotted against the flow Q. Moreover, three facility characteristic curves A, B and C are represented in the diagram according to FIG. 3, and these represent the pressure loss in the hydraulic circuit in a manner depending on the flow Q. On operation, an operating point at the interaction point of the pump characteristic curve with the facility characteristic curve sets in. For example, if the circulation pump assembly is operated at the pump characteristic curve I and the hydraulic facility, in which the circulation pump assembly is applied, has the facility characteristic curve A, then the operating point 14 at the intersection point of both characteristics curves sets in.

Figure 2:
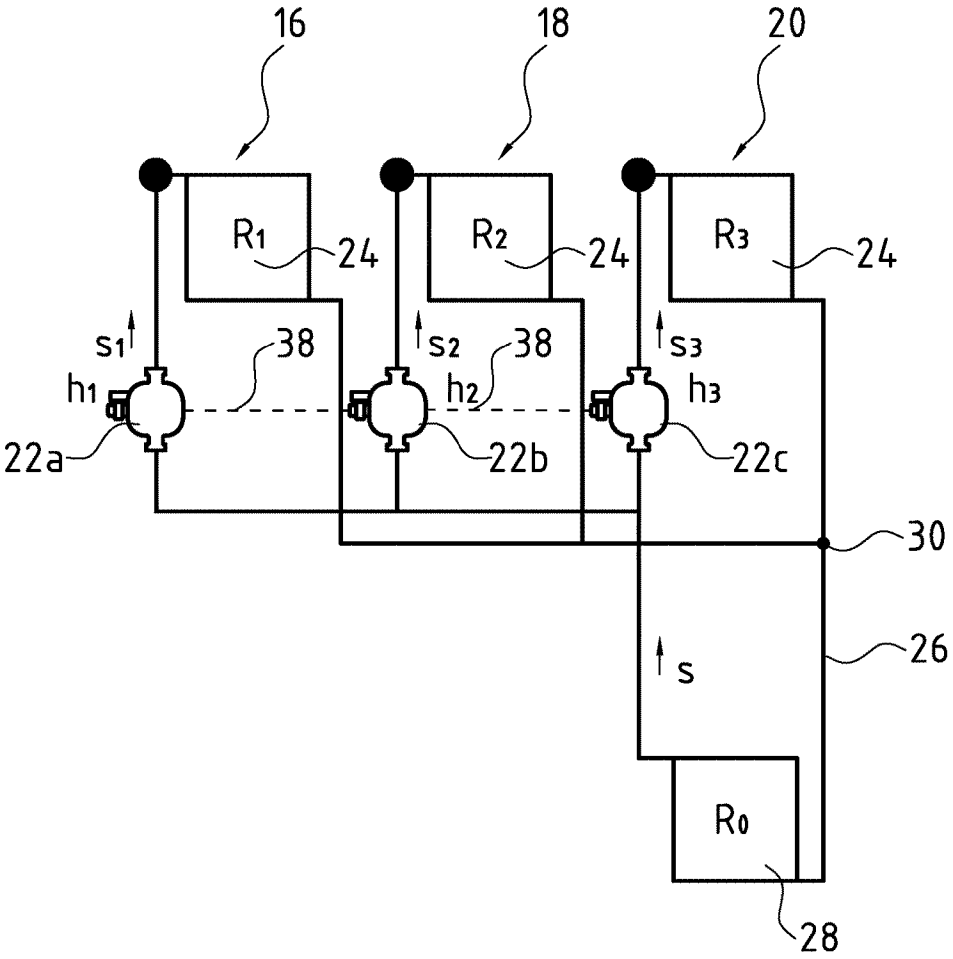
FIG. 2 is a schematic view of a hydraulic system with an arrangement of three circulation pump assemblies according to the invention.

FIG. 2 schematically shows a heating facility with three heating circuits or heating branches 16, 18 and 20. A circulation pump assembly 22*a*, 22*b* or 22*c* is arranged in each of the heating circuits 16, 18, 20 of the hydraulic system, and one or more consumers 24 such as for example a radiator or loops of a floor heating are present. The three heating circuits 16, 18, 20 moreover lead through a common flow path 26 which runs through a heat source 28 such as for example a heating boiler. The three heating circuits 16, 18, 20 branch away from one another in the flow direction s at the outlet side of the heat source 28 and run through the circulation pump assemblies 22*a*, 22*b* and 22*c* through the respective consumer 24 of the three heating circuits 16, 18, 20. At the exit side of the consumer 24, the three heating circuits again run out again into the common flow path 26, at the run-out point 30. The three heating circuits 16, 18, 20 for example can heat different parts of a building, and alternatively for example the heating circuit 16 can be a heating circuit for a floor heating, whereas the heating circuits 18 and 20 represent heating circuits with normal radiators.

Figure 4:
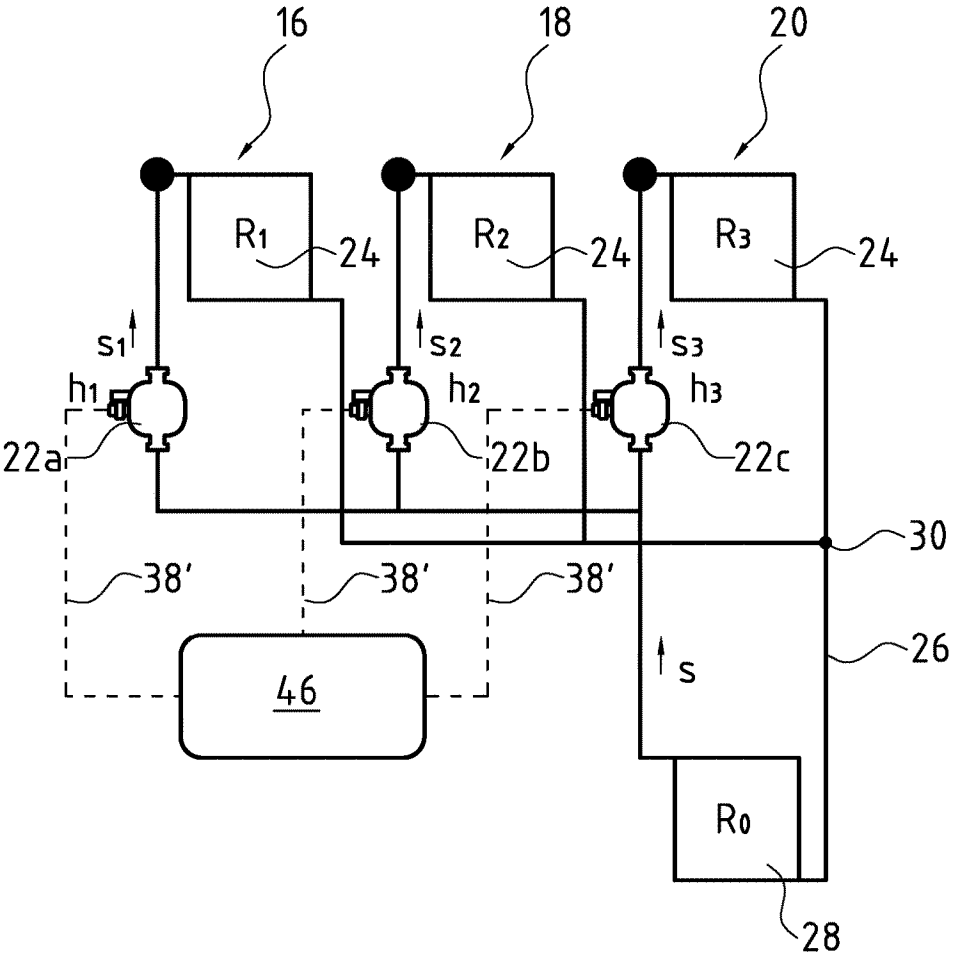
FIG. 4 is a schematic view of a hydraulic system with three circulation pump assemblies according to the invention, according to a second embodiment of the invention.
Figure 5:
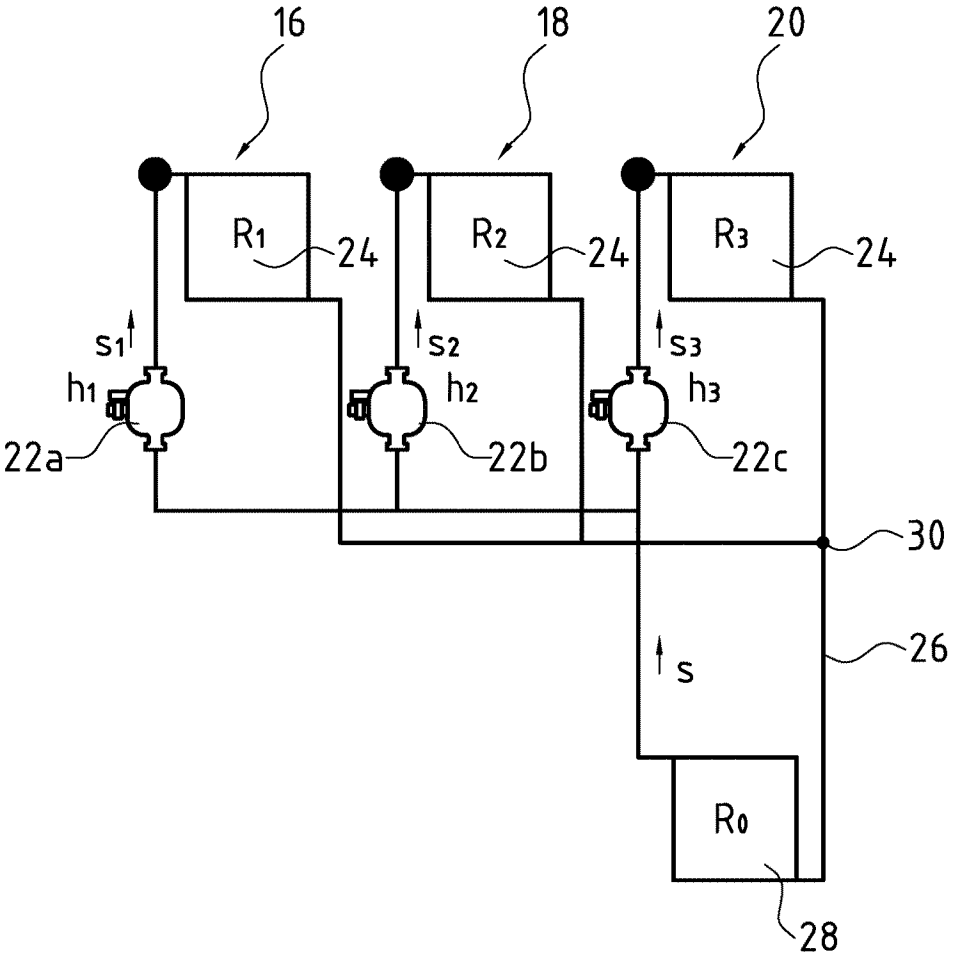
FIG. 5 is a schematic view of a hydraulic system according to FIG. 4, with an arrangement of three circulation pump assemblies according to the invention, according to a third embodiment of the invention.

It is to be understood that concerning the arrangements shown in the FIGS. 2, 4 and 5, the flow direction s could also run in the opposite direction. I.e. in the shown examples, the hydraulic load or the hydraulic resistance which is formed by the consumers 24 lies downstream of the circulation pump assemblies 22. With an opposite flow direction, the consumers 24 would lie upstream of the circulation pump assemblies 22. This could be the case for example if the several heating circuits 16, 18, 20 heat different apartments and the circulation pump assemblies 22 are each part of an apartment station.

The flow through the common flow part 26 and thus the pressure loss across the heat source 28 changes, depending on how many of the heating circuits are in operation. This results in the facility characterizes curve changing, as explained by way of FIG. 3. The facility characteristic curve A shown in FIG. 3 represents for example a facility characteristic curve when only one of the circulation pumps 22, for example the circulation pump 22*a* is in operation. If now the heating circuit 18 is brought into operation and for example the circulation pump 22*b* is also additionally brought into operation, then the complete delivery rate through the common flow path 26 and thus the pressure loss across the heat source 28 increases, so that the facility then has the facility characteristic curve B. If now the circulation pump assembly 22*a* is operated at the pump characteristic curve I, then the operating point would then move on this pump characteristics curve I from the operating point 14 into the operating point 32 which represents the intersection point between the pump characteristic curve I and the facility characteristic curve B. I.e. the circulation pump assembly 22 would reduce its speed, and the flow and the pressure would decrease. This would result in the heating circuit 16 and the consumer 24 no longer being adequately supplied, i.e., the flow through the consumer 24 would not be able to be kept constant.

In order to compensate this, the control device 12 of the circulation pump assembly is configured such that its control schema can be changed in dependence on the operation of further circulation pump assemblies 22 in parallel branches 18, 20 of the hydraulic system. The control device 12 can therefore shift the pump characteristics curve I which is used as a control schema, for example such that the circulation pump assembly is operated according to the second pump characteristic curve II, whose intersection point with the facility characteristic curve B forms a new operating point 34 which lies at the same flow $q_1$ as the operating point 14. The flow $q_1$ through the consumer 24 of the heating circuit 16 can therefore be kept constant. The pressure H is simultaneously increased so that the higher pressure loss in the common flow path 26 is compensated and the differential pressure across the consumer 24 can also ideally be kept constant. For this, the circulation pump assembly 22*a* increases its speed and hence also its electrical power consumption. If the second circulation pump assembly 22*b* is switched off again, then the control schema is then changed back to the initial pump characteristic curve I and the circulation pump assembly 22*a* is again operated with the pump characteristic curve I at the operating point 14.

If the third circulation pump assembly 22*c* in the third heating circuit 20 is also simultaneously brought into operation, then the pressure loss across the heat source 28 increases further and the facility characteristic curve assumes the form of the facility characteristic curve C in FIG. 3. In this case, the control schema of the circulation pump assembly 22*a* can then be changed such that it is operated according to the pump characteristic curve III in FIG. 3, so that the operation is effected at the operating point 36 which represents the intersection point between the facility characteristic curve C and the pump characteristic curve III. Here too, the flow $q_1$ is held constant, but the pressure H increases so that the increased pressure loss in the common flow path 26 is compensated, and the heating circuit 16 continues to be supplied with an essentially constant flow. An adaptation of the control schemas of the circulation pump assemblies 22*b* and 22*c* in the heating circuits 18 and 20 is effected in the corresponding manner, depending on how many of the respective other heating circuits 16, 18, 20 are in operation. Here, it is to be understood that the circulation pump assembly 22*a*, 22*b*, and 22*c* does not necessarily need to be brought into operation in this sequence. For example, depending on the thermal requirement in the individual heating circuits 16, 18, 20, for example also only the circulation pump assembly 22*c* can be in operation and the circulation pump assembly 22*a* and 22*b* be subsequently taken into operation. Here, arbitrary combinations and sequences are conceivable.

The necessary compensations can be computed from the hydraulic variables in the subsequently described manner. The consumers 24 in the heating circuits 16, 18, 20 have the hydraulic resistances $R_1$, $R_2$, and $R_3$. The flows $s_1$, $s_2$ and $s_3$ which are caused by the respective circulation pump assembly 22*a*, 22*b*, and 22*c* prevail in the three hydraulic circuits 16, 18, 20 which are shown in FIG. 2. The circulation pump assembly 22*a* produces a differential pressure $h_1$, the circulation pump assembly 22*b* a differential pressure $h_2$ and the circulation pump assembly 22*c* a differential pressure $h_3$. A flow s prevails in the common branch or flow path 26 and the heat source 28 forms a hydraulic resistance $R_0$. Here, it is to be understood that the hydraulic resistances $R_0$, $R_1$, $R_2$, $R_3$ not only represent the hydraulic resistance of the consumers or the heat source, but the complete hydraulic resistance in the respective branch, said resistance being formed by the conduit losses and the like. In a hydraulic heating system, the hydraulic resistances $R_1$, $R_2$ and $R_3$ vary, for example in a manner depending on the opening degree of a thermostat valve in the respective heating circuit 16, 18, 20.

If the differential pressures across the hydraulic resistances $R_1$, $R_2$, $R_3$ are to be constant and regulated to a constant value, which is effected by the control device of the respective circulation pump assembly 22, then each branch has a differential pressure setpoint h* which is to be achieved across the hydraulic resistance R. In this case, the following results for the differential pressure $h_1$, $h_2$, $h_3$ which is to be achieved by the respective pumps:

$$h_1=h^*+R_0s^2=h^*+R_0(s_1+s_2+s_3)^2$$

$$h_2=h^*+R_0s^2=h^*+R_0(s_1+s_2+s_3)^2$$

$$h_3=h^*+R_0s^2=h^*+R_0(s_1+s_2+s_3)^2$$

It is to be recognized that the pump differential pressure $h_1$, $h_2$ and $h_3$ is dependent on the flow through all branches and on the hydraulic resistance $R_0$ in the common branch.

There can also be the case, in which the circulation pump assembly 22 is not to be regulated to a constant pressure but to a proportional pressure in a manner depending on the flow, in order to produce a proportional pressure curve. The pressure setpoint h* would then result as a value dependent on the flow, for the heating circuit 16 for example:

$$h^*=as_1^2+b$$

In this equation, a and b represent parameters of the proportional pressure curve.

In order to be able to take into account the pressure losses in the common flow path 26, it is therefore necessary to know and determine the hydraulic resistance $R_0$ in this common flow path. The hydraulic resistances $R_1$, $R_2$ and $R_3$ as a rule change very slowly on adjusting the thermostat valves in the heating circuits. This permits the hydraulic resistance $R_0$ to be determined by way of switching the circulation pump assemblies 22 on and off in short time intervals, since the hydraulic resistances $R_1$, $R_2$ and $R_3$ do not essentially change in these short time intervals.

In order to determine the hydraulic resistance $R_0$, firstly, preferably by way of a suitable communication via the subsequently described communication interfaces 40 and the data connections 38, the control devices 12 of the circulation pump assemblies are initiated into bringing all circulation pump assemblies 22*a*, 22*b* and 22*c* into operation. Thereby, the differential pressures $h_1$, $h_2$, $h_3$ and the flows $s_1$, $s_2$ and $s_3$ are each determined by the control devices 12 and are preferably exchanged amongst one another via the data connections 38. The detection of these values can be effected by way of suitable sensors in the circulation pump assemblies 22 and/or by way of computation on the basis of electrical variables drive motors of the respective circulation pump assembly 22. After these readings have been detected, the circulation pump assembly 22*b* for example can be switched off and the pressure values $h_1$, $h'_2$, $h_3$ and flows $s'_1$, $s'_2$ and $s'_3$ can be determined. The hydraulic resistance $R_0$ in the common flow path 26 can be derived from these measurements, by way of solving the following equation system with two unknowns.

A first example is based on the pressure $h_1$ of the circulation pump assembly 22*a:*

$$h_1=R_0(s_1+s_2+s_3)^2$$

$$h_1=R_1s'^2_1+R_0(s'_1+s'_3)^2$$

$R_0$ results from this:

$$R_0 = \frac{s_1'^2 h_1 - s_1^2 h_1}{s_1'^2(s_1+s_2+s_3)^2 - s_1^2(s_1'+s_2')^2}$$

A second example is based on the pressure $h_2$ of the circulation pump assembly 22*b:*

$$h_2=R_2s_2^2+R_0(s_1+s_2s_3)^2$$

$$h'_2=R_0(s'_1+s'_3)^2$$

$R_0$ results from this:

$$R_0 = \frac{h_2'}{(s_1'+s_2')^2}$$

A third example is based on the pressure $h_3$ of the circulation pump assembly 22*c:*

$$h_3=R_3s_3^2+R_0(s_1+s_2+s_3)^2$$

$$h_3=R_3s'^2_3+R_0(s'_1+s'_3)^2$$

A solution similar to the solution for the circulation pump assembly 22*a* results for this equation system.

It is likewise possible to carry out additional tests or measurements, for example by way of the circulation pump assembly 22*b* and the circulation pump assembly 22*c* being switched off. Thereby, the following three equations can result for example for the circulation pump assembly 22*a:*

$$h_1=R_1s_1^2+R_0(s_1+s_2+s_3)^2$$

$$h_1=R_1s'^2_1+R_0(s'_1+s'_3)^2$$

$$h_1=R_1s'^2_1+R_0s'^2_1$$

These equations can be solved by way of a linear regression.

There can also be cases, in which it is not possible to switch off one of the circulation pump assemblies 22. In such a case, it can also possible to merely change the differential pressure h across the respective circulation pump assembly 22 by way of speed change. For example, the pressure of the circulation pump assembly 22*b* could be changed from $h_2$ to $h'_2$ by way of a speed change. The following equations for the three circulation pump assemblies 22*a*, 22*b* and 22*c* result from this:

$$h_1=R_1s_1^2+R_0(s_1+s_2+s_3)^2$$

$$h_1=R_1s'^2_1+R_0(s'_1+s'_2+s'_3)^2$$

$$h_2=R_2s_2^2+R_0(s_1+s_2+s_3)^2$$

$$h'_2=R_2s'^2_2+R_0(s'_1+s'_2+s'_3)^2$$

$$h_3=R_3s_3^2+R_0(s_1+s_2+s_3)^2$$

$$h_3=R_3s'^2_3+R_0(s'_1+s'_2+s'_3)^2$$

The hydraulic resistance $R_0$ can be determined from these. Once the hydraulic resistance $R_0$ in the common branch 26 has been determined in this manner after an initial test, then later, given a flow change by way of connecting or speed change of one of the circulation pump assemblies 22, the change of the flow s in the common flow paths 26 can be taken into account for the adaptation of the pump characteristic curve in each individual circulation pump assembly 22. The pump characteristic curve I, II, III is thereby preferably shifted by an amount or a correction value which is proportional to the hydraulic resistance $R_0$ in the common flow path 26 and is an increasing function of the sum of the flows, i.e. of the flow s in the common flow path 26.

In order to achieve the described functionality of the adaptation of the control schemas in dependence on the operation of the circulation pump assemblies 22 in the parallel heating circuits 16, 18, 20, according to the invention, a communication is provided between the circulation pump assemblies 22*a*, 22*b* and 22*c*. According to a first embodiment example of the invention which is shown in FIG. 2, the circulation pump assemblies 22*a*, 22*b*, and 22*c* can be connected to one another in a direct manner via data connections 38. Here, the data connections 38 can be realized as a cable borne data bus or also in a wireless manner by way of radio connections. The control devices 12 of the circulation pump assemblies 22 comprise a communication interface 40 for this. In the inside of the control device 12, this interface cooperates with a detection module 42 which provides a detection function. The detection module 42 can be realized in the control device as a software module. The control devices 12 moreover each comprise a signal generating device 44 which according to a first embodiment example can likewise be connected to the communication interface 40, as is shown in FIG. 1. In as much as this is concerned, the communication interface 40 in this embodiment example therefore acts preferably bidirectionally. The signal generating device 44 can also be realized as a software module in the control device 12.

On operation of the respective circulation pump assembly 22, the signal generating device 44 produces a signal which represents a condition variable and which is outputted to the further circulation pump assemblies 22 via the communication interface 40 and the data connection 38. In the simplest form, the condition variable can merely signalize that the respective circulation pump assembly 22 is or will be switched on or off. Alternatively, the condition variable can be a delivery rate value which represents the respective flow rate of the pump assembly 22. The delivery rate can either be measured in the circulation pump assembly 22 or be derived by the control device 12 from electrical variables.

If now, for example in the embodiment example according to FIG. 2, as described above, firstly only the circulation pump assembly 22*a* is in operation and the circulation pump assembly 22*b* is later connected, then the signal generating device 44 of the circulation pump assembly 22*b* produces for example a delivery rate value which specifies the delivery rate of the second circulation pump assembly 22*b*. This delivery rate value is transferred to the first circulation pump assembly 22*a* via the communication interface 40 and the data connection 38. The control device 12 of the first circulation pump assembly process this signal in the detection module 42 in a manner such that it now recognizes the change of the facility characteristic curve from the facility characteristic curve A to the facility characteristic curve B and accordingly changes the control schema of its control device 12, e.g. from the pump characteristic curve I to the pump characteristic curve II. This is effected in the corresponding manner on connecting the third circulation pump assembly 22*c*, by way of the circulation pump assembly 22*c* also transferring its delivery rate value to the circulation pump assembly 22*b* and circulation pump assembly 22*a* via the data connection 38, so that these two circulation pump assemblies can then again accordingly change their pump characteristic curve as a control schema. Conversely, the circulation pump assembly 22*c* also receives the delivery rate values from the circulation pump assemblies 22*a* and 22*b*, so that directly on starting operation, it can accordingly adapt its control schema to the hydraulic condition of the system which results from the simultaneous operation of the other circulation pump assemblies 22*a* and 22*b*.

Instead of transferring the delivery rate values via the data connection 38 in a direct manner, as described, a signal which merely signalizes the switching-on and switching-off can also be transferred. If only the switching-on or the operation of the second circulation pump assembly 22*b* is communicated to the control device 12 of the first pump assembly 22*a*, then via the detection module 42 and from the change of the electrical variables and possibly hydraulic variables measured directly in the circulation pump assembly 22*a*, the control device 12 can automatically recognize how the facility characteristic curve changes and carry out a corresponding adaptation of the pump characteristic curve. This can be effected in the other two circulation pump assemblies 22*b* and 22*c* in a corresponding manner.

In an alternative manner, the networking or linking for communication between the circulation pump assemblies 22*a*, 22*b* and 22*c* can also be effected as is shown for example in FIG. 4. There, the linking is effected via a central control appliance 46. The control appliance 46 is connected to the circulation pump assemblies 22 in each case via individual data connections 38'. Thereby, the data connections 38' can again configured wire-connected or also configured wireless, for example as radio connections. The central control appliance 46 can therefore be configured such that it assumes the complete function of the control devices 12 in the manner such that it specifies the respective speed for the drive motor 10 to the circulation pump assemblies 22*a*, 22*b*, 22*c*, for example via a PWM signal input of the circulation pump assemblies 22*a*, 22*b* and 22*c*. Alternatively, the control appliance 46 can also merely assume the function of transferring the condition variables or signals between the circulation pump assemblies 22, as has been described above. In particular, this can be useful if the communication interfaces 40 of the control devices 12 are galvanically separated from the remaining parts of the control device, so that the communications connections 38' require an external energy supply via the control appliance 46.

According to a third possible embodiment which is described by way of FIG. 5, the communication between the circulation pump assemblies 22*a*, 22*b* and 22*c* is effected hydraulically. I.e., in this embodiment example, the circulation pump assemblies 22*a*, 22*b*, 22*c* require no communication interface 40. In contrast, the signal generating device 44 produces a hydraulic signal on starting operation of the respective circulation pump assembly 22, by way of the drive motor 10 being brought into operation according to a defined pattern, for example being briefly switched on and off several times in a certain pattern before being put into permanent operation. This leads to pressure fluctuations in the complete hydraulic system, said fluctuations being able to be detected by the other circulation pump assemblies 22 on the basis of a brief change of the hydraulic condition, for which the detection module 42 of the circulation pump assembly 22 is configured accordingly. If a circulation pump assembly 22 in the system recognizes the pattern which signalizes the starting operation of a further circulation pump assembly 22, then it can recognize the change of the facility characteristic curve A, B, C from its electrical variables or internal sensor signals and adapt the pump characteristic curve I, II, III accordingly, as has been described above. Such a hydraulic signal which signalizes the operation of a pump assembly can possibly also be produced in a recurring manner in regular intervals by the signal generating device 44, so that the circulation pump assemblies 22 via their detection devices or detection modules 42 can continuously monitor whether further circulation pump assemblies 22 are in operation in the same hydraulic system.

While specific embodiments of the invention have been shown and described in detail to illustrate the application of the principles of the invention, it will be understood that the invention may be embodied otherwise without departing from such principles.

The invention claimed is:

1. A circulation pump assembly comprising:

an electrical drive motor; and an electronic control device for control of the drive motor, wherein the electronic control device is configured to regulate a speed of the drive motor according to a control schema and the electronic control device comprises a detection unit configured to detect a condition variable representing an operating condition, of a parallel flow path with a second circulation pump assembly associated with only a single individual hydraulic branch of a hydraulic system having a single hydraulic resistance active in the single hydraulic branch, and the electronic control device is configured to change the control schema on the basis of the condition variable detected by the detection unit such that a differential pressure across a hydraulic resistance in another individual hydraulic branch of the hydraulic system connected to an outlet side of the circulation pump assembly is retained on a predefined value.

2. A circulation pump assembly according to claim 1, wherein the detection unit is configured to detect, as the condition variable a signal which represents the switching-on and/or switching-off or a speed change at least of a second circulation pump assembly, and the electronic control device is configured to control the drive motor whilst taking into account this detected signal.

3. A circulation pump assembly according to claim 2, wherein the detection unit is configured to recognize a signal in a form of at least one predefined pattern of a hydraulic load acting upon the circulation pump assembly.

4. A circulation pump assembly according to claim 1, wherein the electronic control device comprises a communication interface connected to the detection unit such that the detection unit receives a signal via the communication interface.

5. A circulation pump assembly according to claim 1, wherein the electronic control device comprises a signal generating device configured to produce a signal which represents the switching-in and/or switching-off or a speed change of the drive motor.

6. A circulation pump assembly according to claim 5, wherein the signal generating device is configured to produce a hydraulic signal.

7. A circulation pump assembly according to claim 1, wherein the electronic control device comprises a communication interface which is connected to the signal generating device such that the signal generating device emits a signal or a value, via the communication interface.

8. A circulation pump assembly according to claim 7, wherein the signal generating device is configured to output a delivery rate value representing the current delivery rate of the circulation pump assembly, via the communication interface.

9. A circulation pump assembly according to claim 8, wherein the communication interface is configured for the communication connection with a communication interface of at least the second circulation pump assembly of the same type, the electronic control device is configured such that, via the communication interface and the detection function, the electronic control device receives the condition variable from at least the second circulation pump assembly of the same type via the communication interface of this second circulation pump assembly and that the electronic control device controls the drive motor whilst taking into account the condition variable received from the communication interface.

10. A circulation pump assembly according to claim 8, wherein the communication interface is designed for communication with several second circulation pump assemblies of the same type, and the electronic control device controls the drive motor whilst taking into account all condition variables received from the communication interface.

11. A circulation pump assembly according to claim 1, wherein the electronic control device is configured such that the control schema, according to which the drive motor is regulated, comprises a pump characteristic curve which is changed and shifted, in dependence on a signal which is recognized or received by the detection function, in dependence on a received condition variable.

12. A circulation pump assembly according to claim 11, wherein the electronic control device is configured such that the pump characteristic curve is shifted by a correction value which represents a function of a received or detected condition variable.

13. A circulation pump assembly according to claim 1, wherein the electronic control device is configured such that after receiving a signal from the detection function, the electronic control device automatically changes the control schema in dependence on the change of the hydraulic load and shifts a pump characteristic curve which forms the control schema.

14. A circulation pump assembly according to claim 1, wherein the electronic control device is configured such that the electronic control device changes the control schema given a predefined condition variable which is detected by the detection function, such that the drive motor is switched off.

* * * * *